United States Patent [19]

Kinoshita

[11] Patent Number: 4,711,200

[45] Date of Patent: Dec. 8, 1987

[54] AUTOMOTIVE-ENGINE FUEL SUPPLY SYSTEM

[75] Inventor: Yoshiaki Kinoshita, Susono, Japan

[73] Assignee: Toyota Jidosha Kabushiki Kaisha, Aichi, Japan

[21] Appl. No.: 906,313

[22] Filed: Sep. 11, 1986

[30] Foreign Application Priority Data

Sep. 13, 1985 [JP] Japan ..... 60-201831

[51] Int. Cl.[4] ..... F02D 41/10

[52] U.S. Cl. ..... 123/492; 123/487

[58] Field of Search ..... 123/492, 487

[56] References Cited

U.S. PATENT DOCUMENTS 4,488,529 12/1984 Nishida et al. ..... 123/492

FOREIGN PATENT DOCUMENTS 58-51241 3/1983 Japan .

59-170430 9/1984 Japan ..... 123/492

*Primary Examiner*—Andrew M. Dolinar

*Attorney, Agent, or Firm*—Kenyon & Kenyon

[57] ABSTRACT

A fuel supply system controls the amount of fuel to form a stoichiometric combustible mixture during a normal operating condition of the engine. The mixture is enriched during a transient condition to lower the exhaust gas temperature and to reduce the heat load on the exhaust system. Fuel enrichment is delayed for a delay time which varies depending on the time interval between successive acceleration cycles, to minimize fuel consumption while avoiding overheating of the exhaust system.

2 Claims, 7 Drawing Figures

AUTOMOTIVE-ENGINE FUEL SUPPLY SYSTEM

BACKGROUND OF THE INVENTION

1. Field of the Invention

The present invention relates to a fuel supply system for an automotive engine.

2. Description of the Related Art

It is known in the art that the temperature of an exhaust gas from the engine rises in response to an increase in the engine speed and engine load, and in response to a retardation of the spark advance, so that a continued high-speed heavy load operation of the engine will result in a temperature rise of an exhaust system. It is also known that, assuming the engine speed, engine load and spark advance to be constant, the exhaust gas temperature reaches a maximum value when the engine is operating with a combustible mixture having a stoichiometric air/fuel ratio. The exhaust gas temperature becomes lower as the air/fuel ratio becomes less than the stoichiometric ratio, i.e., as the combustible mixture is enriched.

Overheating of the exhaust system must be avoided because it adversely affects the exhaust gas purifier and turbocharger provided in the exhaust system. Therefore, it has been customary to enrich the combustible mixture during the high-speed heavy-load condition of the engine in order to lower the exhaust gas temperature below an acceptable point, while normally operating the engine with a stoichiometric combustible mixture during the steady speed condition.

From the viewpoint of fuel economy, however, it is desirable to minimize the needs for an enriched combustible mixture. To this end, based on the recognition that there is a certain time delay before the exhaust gas temperature is raised during the transitional condition of the engine, it has been proposed in the prior art that enrichment of combustible mixture be postponed for a predetermined delay time. For example, Japanese Unexamined Patent Publication No. 58-51241 discloses a fuel supply system wherein a stoichiometric mixture is supplied during a steady speed condition and the mixture is enriched only upon elapse of a time delay after the engine load is increased during a transient condition. In this system, the delay time is varied in accordance with the engine load and engine speed, in such a manner that, under a heavy load condition wherein the temperature rise in the exhaust system occurs in a shorter period, the delay time is correspondingly shortened to avoid undesirable overheating. Also, Japanese patent application No. 59-174017 filed Aug. 23, 1984 proposes to vary the fuel enrichment delay time in response to coolant temperature.

In those fuel systems wherein the enrichment of the combustible mixture is delayed, the temperature rise in the exhaust system will be prohibitive if the delay time is set for a larger value and, conversely, the fuel consumption will be adversely affected if the delay time is made shorter. That is, the delay time must meet two opposing requirements for reducing the temperature of the exhaust system and for fuel economy, and it has been difficult to satisfy both requirements. This problem will be discussed in more detail with reference to FIG. 7 wherein a composite time chart is shown illustrating the function of a typical fuel supply system adapted to enrich the combustible mixture for the purpose of suppressing the exhaust gas temperature rise during the transient condition. In the chart of FIG. 7, curve (a) represents the running mode of a vehicle in terms of the vehicle speed indicated by the ordinate. Curve (a) indicates that the vehicle has undergone four acceleration cycles during the illustrated running mode. Curve (b) represents the rate of fuel enrichment with respect to the stoichiometric mixture, which rate is computed in accordance with the engine load, engine speed and other engine parameters. Curve (c) indicates the count of a delay counter for counting the fuel enrichment delay time. Two alternative values A and B are shown as indicating the preset value for the counter, meaning that fuel enrichment is performed as shown in curve (d) when the counter counts over the preset value A or B. It will be understood that if the smaller preset value B is selected, the combustible mixture is enriched for each acceleration cycle as shown by the dotted line in curve (d), resulting in an increased fuel consumption. Conversely, if the larger value A is selected as the preset value for counting over the delay time, then fuel enrichment is not performed in the first, second, and fourth acceleration cycles, and the mixture is enriched as shown by the solid line of curve (d) only in the third acceleration cycle wherein acceleration is continued for an extended period, thereby resulting in the imposition of a drastic heat load on the exhaust system. It will be noted that, when the vehicle running mode is such that the first and second acceleration cycles as shown by curve (b) are repeated, no fuel enrichment is performed at all, thereby causing a danger that the exhaust system will overheat.

SUMMARY OF THE INVENTION

The object of the present invention is to improve the above-referenced previously proposed automotive engine fuel supply system of the type wherein a stoichiometric combustible mixture is supplied during the steady speed operating condition of the engine, and wherein the mixture is enriched during the high-speed high-load condition for the purpose of preventing an undesirable exhaust gas temperature rise. More specifically, the object of the invention is to provide a fuel supply system which is capable of varying the fuel enrichment delay time in accordance with running mode of the vehicle in such a manner that fuel enrichment is performed based on an actual heat load imposed on the exhaust system, and that the rate of fuel consumption is optimized.

The present invention is based on the finding that the disadvantage of the previously proposed fuel systems is that, in a given running mode of the vehicle wherein acceleration cycles are successively repeated, the delay counter is reset to zero to restart counting upon completion of individual acceleration cycles, and that the counter is preset with the same preset value regardless of whether the acceleration cycles are repeated within a short interval.

In view of this, a feature of the present invention is that the fuel enrichment delay time is decreased when the vehicle is running in a mode wherein acceleration cycles are successively repeated within a predetermined interval. When the running mode is such that an ample time elapses between successive acceleration cycles, the delay time is increased to retard fuel enrichment.

According to the invention, the fuel supply system comprises; (a) means responsive to an amount of intake air per one revolution of the engine for computing a basic fuel supply amount per one revolution required to form a stoichiometric combustible mixture, (b) means responsive to engine speed and engine load for computing an additional fuel supply, (c) means responsive to an accelerating condition of the engine for monitoring a time interval between successive acceleration cycles of the engine, (d) means responsive to the time interval monitoring means, for setting a variable delay time that increases in response to an increase in the time interval between successive acceleration cycles, and (e) electronically operated fuel supply means responsive to the variable delay time setting means, for supplying the engine, at each revolution thereof, with fuel in an amount substantially equal to the basic fuel supply amount when an actual acceleration period counted from commencement of each acceleration cycle is less than the delay time, and in an amount substantially equal to the sum of the basic fuel supply amount and the additional supply amount when the actual acceleration period from the commencement of each acceleration cycle exceeds the delay time.

With this arrangement, the delay time for retarding the fuel enrichment timing is shortened to promptly provide an enriched air/fuel mixture required to avoid the temperature rise in the exhaust system, when the vehicle is running in a mode in which acceleration cycles are repeated successively within a short time interval. On the other hand, when the acceleration cycles are repeated within an interval long enough to allow the exhaust system to be cooled below a tolerable temperature, the delay time is increased to avoid unnecessary fuel consumption. These and other objects and features of the invention will be more readily understood from the following description made with reference to the drawings.

DESCRIPTION OF THE PREFERRED EMBODIMENTS

Figure 1:
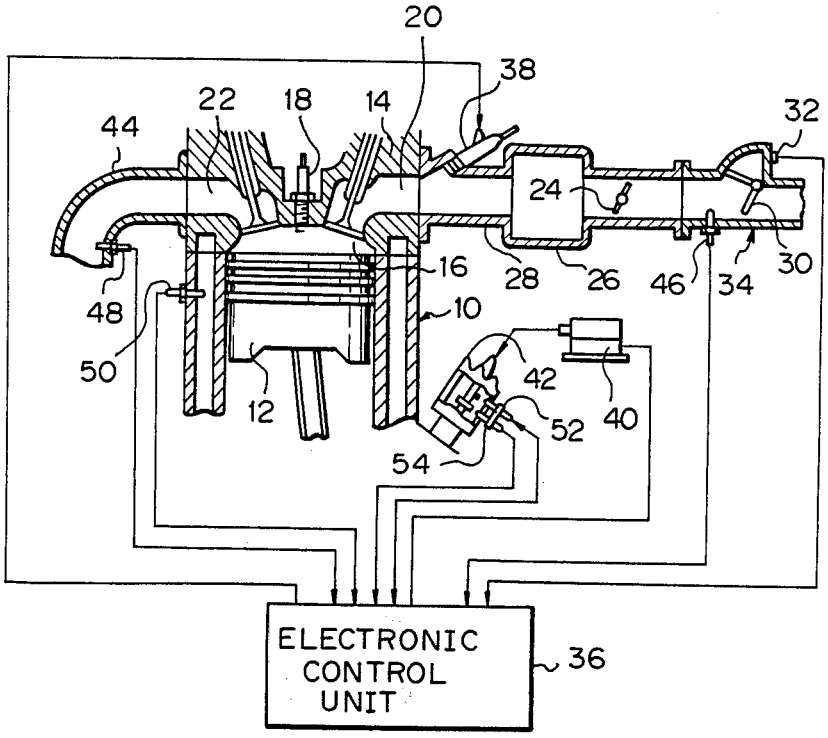
FIG. 1 is a schematic representation, partly in a block diagramatic form, of an internal combustion engine equipped with the electronic fuel supply system according to the invention.

Referring to FIG. 1, there is shown an internal combustion engine incorporating a fuel injection system embodying the fuel supply system according to the invention. Nevertheless, it is understood that the present invention also may be applicable to a carburetted fuel supply system.

As is well known to those skilled in the art, the engine includes a cylinder block 10 having a plurality of engine cylinders each receiving a piston 12. A conventional cylinder head 14 cooperates with the cylinder bores to define combustion chambers, one of which is shown at 16. The cylinder head 14 is provided with a spark plug 18, an intake port 20, and an exhaust port 22 for each cylinder. A flow of intake air is controlled by a throttle valve 24 and is drawn into the engine cylinders through a surge tank 26, an intake manifold 28, and respective intake ports 20. The flow rate of intake air is detected by a conventional airflow meter 34 having a measuring plate 30 and a potentiometer 32 which delivers analog signals proportional to the opening of the measuring plate 30 to an electronic control unit 36.

Solenoid operated fuel injectors 38, provided one for each engine cylinder, are mounted at the intake manifold 28 and receive fuel under a controlled pressure from a delivery line, not shown. The fuel injectors 38 are energized by electric pulses from the control unit 36 to intermittently inject a controlled amount of fuel proportional to the pulse width into the intake air stream to form a combustible mixture. The electronic control unit 36 delivers an ignition signal, at a controlled timing, to an igniter 40, which produces a high tension voltage which is distributed through a distributor 42 to a spark plug 18 to ignite the combustible mixture drawn into a particular combustion chamber 16. The exhaust gas is discharged into the ambient atmosphere through exhaust ports 22, exhaust manifold 44, and an exhaust pipe (not shown).

Various conventional sensors are used to detect engine parameters required to control the air/fuel ratio of the combustible mixture. These sensors include the previously mentioned airflow meter 32, a sensor 46 for detecting the intake air temperature, an oxygen sensor 48 for detecting the presence or absence of oxygen in the exhaust gas, and a coolant temperature sensor 50. The distributor 42 incorporates, in a known manner, a first crank angle sensor 52 adapted to issue one pulse signal for every two revolutions of the engine crank shaft and a second crank angle sensor 54 designed to output one pulse signal for every 30° revolution of the crank shaft. The signals from these sensors are sent to the electronic control unit 36, which operates to control the ignition timing based on the detected engine conditions.

The fuel supply system of the invention is implemented in part by the electronic control unit 36.

Figure 2:
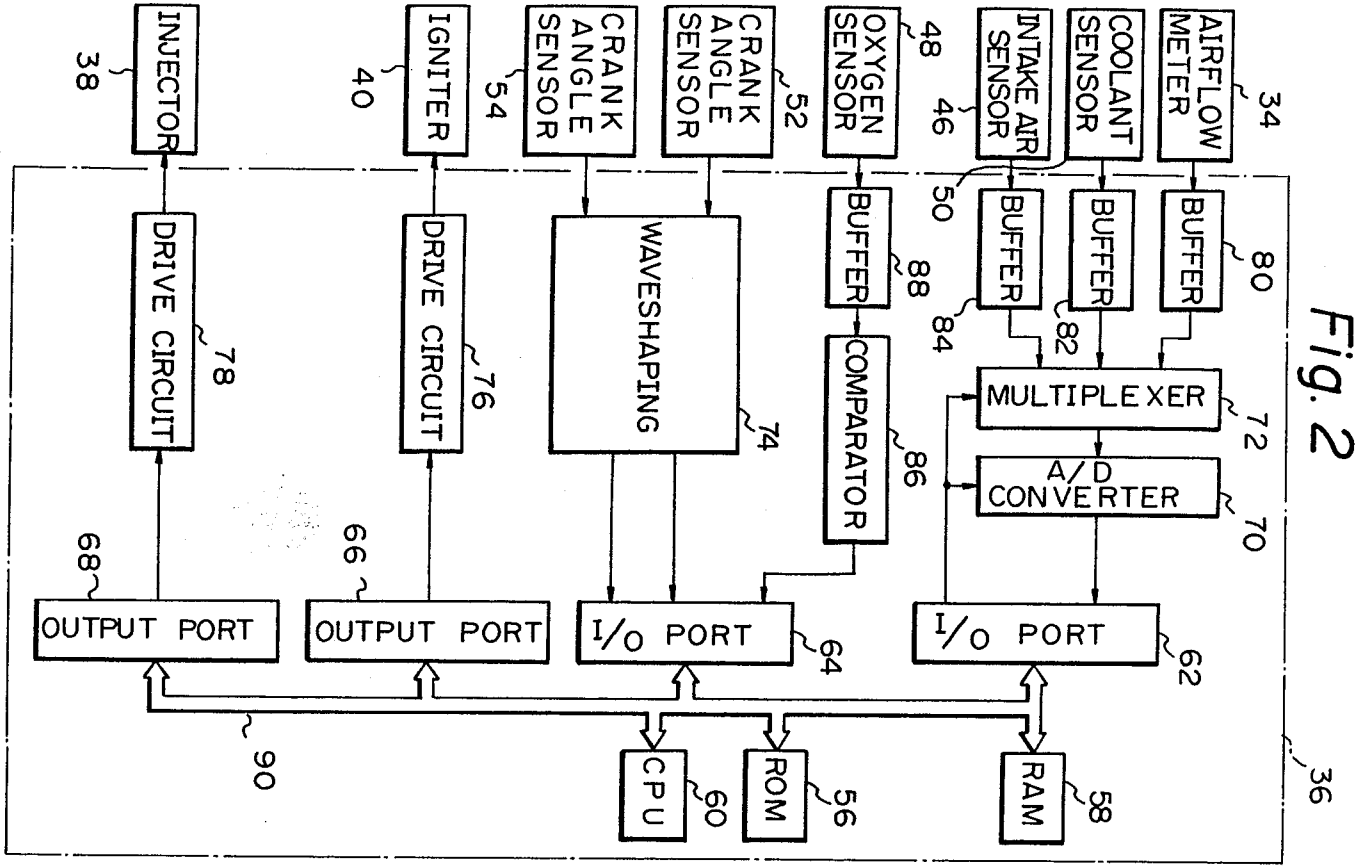
FIG. 2 is a block diagram of an electronic control unit shown in FIG. 1 as connected to various associated components.

Referring to FIG. 2, the electronic control unit 36 may comprise a conventional programmable microcomputer including a read-only-memory (ROM) 56 for storing various data and a program for the computer, a random-access-memory (RAM) 58 for temporarily storing various processed data, a central processing unit (CPU) 60, which processes data according to the program stored in the ROM 56, input and output ports 62 and 64, output ports 66 and 68, an A/D converter 70 for converting analog signals selectively input through a multiplexer 72 into digital signals, a waveform shaping circuit 74 for wave-shaping pulse signals received from the crank angle sensors 52 and 54, a drive circuit 76 for amplifying signals from the output port 66 to drive the igniter 40, a drive circuit 78 for amplifying signals from the output port 68 to drive the fuel injectors 38, and buffer amplifiers 80, 82, and 84 for buffering and amplifying output from the airflow meter 34, the coolant temperature sensor 50, and the intake air temperature sensor 46, respectively. Signals from the oxygen sensor 48 are buffered by a buffer 88 and input to a comparator 86. A common bus 90 interconnects the input and output ports 62 and 64, output ports 66 and 68, CPU 60, ROM 56, and RAM 58 to transfer data and instructions therebetween.

The analog signals from the airflow meter 34, coolant temperature sensor 50, and intake air temperature sensor 46 are sent via the multiplexer 72 to the A/D converter 70, which converts the analog signals into binary numbers which are stored in the RAM 58 in accordance with commands from the CPU 60.

The oxygen sensor 48 delivers either a high or a low level signal in response to a presence or absence of oxygen in the exhaust gas, and the comparator 86 compared the oxygen sensor signal with a reference voltage to issue an "0" or "1" output in response to whether the combustible mixture is rich or lean with respect to the stoichiometric air/fuel ratio.

The signals from the crank angle sensors 52 and 54 are reformed by the waveform shaping circuit 74 into rectangular pulses. The pulse signals issued from the crank angle sensor 52 for each 30° rotation of the crank shaft are used to compute the engine speed and to detect the crank angle. The signals issued from the sensor 54 for each 720° rotation of the crank shaft are used as interrupt command signals for initiating computation of the fuel injection quantity and ignition timing.

The output port 68 incorporates an injector control circuit including a presettable down counter and a register. The injector control circuit receives from the CPU 60 binary signals indicating the pulse width of fuel injection pulses and produces a pulse series having a desired pulse width. The pulse series is amplified by the drive circuit 78 and applied in sequence or simultaneously to the fuel injectors 38 of respective cylinders, whereby the injectors are energized for a time period corresponding to the pulse width to inject a metered quantity of fuel into the intake air stream to form a combustible mixture having a desired air/fuel ratio.

The ROM 56 stores therein a program for a main processing routine, a program for an interrupt processing routine for computing the final fuel injection quantity, a program for an interrupt processing routine for computing the additional fuel injection quantity, and various data and tables necessary for the aforementioned routines.

Operation of the fuel supply system will be described with reference to the function of the electronic control unit 36 shown in the flow diagram of FIGS. 3 and 4.

Figure 3:
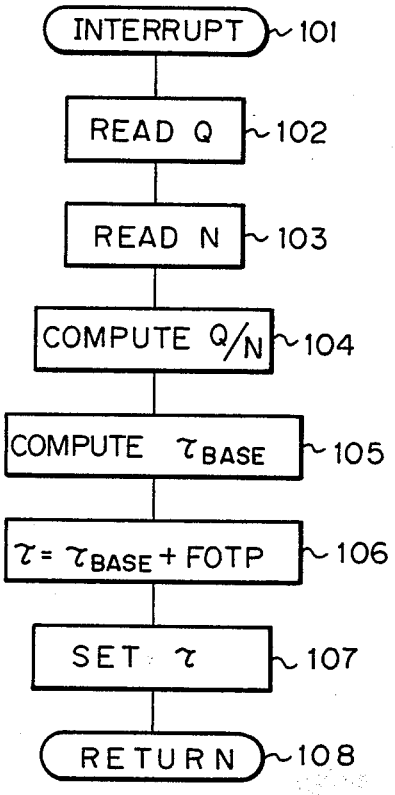
FIG. 3 is a flow diagram showing a routine for computing the fuel injection quantity.

Referring to FIG. 3, the routine is initiated at function 101 at a predetermined crank angle for each revolution of the crank shaft. Function 102 accesses the RAM 58 and reads out the flow rate Q of intake air stored therein and computed based on the signals from the airflow meter 34. Function 103 similarly reads the engine rotational speed N which has been calculated based on the pulses from the crank angle sensor 54. At function 104, the CPU 60 computes the volume Q/N of intake air drawn into the engine per one revolution thereof. Then function 105 computes the basic fuel injection pulse width $\tau_{BASE}$. The basic fuel injection pulse width $\tau_{BASE}$ is considered to represent a width of a fuel injection pulse issued from the output port 68 to the drive circuit 78 to energize the injectors 38 for a time period required to inject an amount of fuel suitable to form a stoichiometric combustible mixture.

Thus, the basic fuel injection pulse width $\tau_{BASE}$ is proportional to the volume Q/N of intake air per one revolution of the engine. Function 105 may be performed as a table look-up routine and interpolation. Then, at function 106, an executive pulse width $\tau$ is computed by summing the basic pulse width $\tau_{BASE}$ and an additional pulse width FOTP described later with reference to the flow diagram of FIG. 4. The additional pulse width FOTP is a pulse width to be added to the basic pulse width $\tau_{BASE}$ in order to inject an additional quantity of fuel to provide an enriched combustible mixture, with respect to the stoichiometric mixture, for suppressing a rise in the exhaust gas temperature. As is well known to those skilled in the art, at function 106 the basic pulse width $\tau_{BASE}$ may be further modified according to other engine parameters such as the intake air temperature sensed by the temperature sensor 46, the air/fuel ratio sensed by the oxygen sensor 48, and the coolant temperature detected by the sensor 50. The function 107 presets the executive pulse width $\tau$ to the presettable down counter provided in the output port 68. The presettable down counter issues an injection pulse having the executive pulse width $\tau$ to a drive circuit 78 to energize the fuel injectors 38 for a time period corresponding to the executive pulse width. As a result, the injectors 38 inject into the intake air stream an amount of fuel required to form a stoichiometric air/fuel mixture plus an additional amount of fuel required to enrich the mixture. It will be understood that, if the additional pulse width FOTP is zero so that the executive pulse width $\tau$ is equal to the basic pulse width $\tau_{BASE}$, then the amount of fuel injected is equal to that required to form a stoichiometric mixture. If the additional pulse width FOTP is larger than zero, then the combustible mixture will be enriched over the stoichiometric air/fuel ratio. Then function 108 returns the CPU 60 to the main routine.

Figure 4:
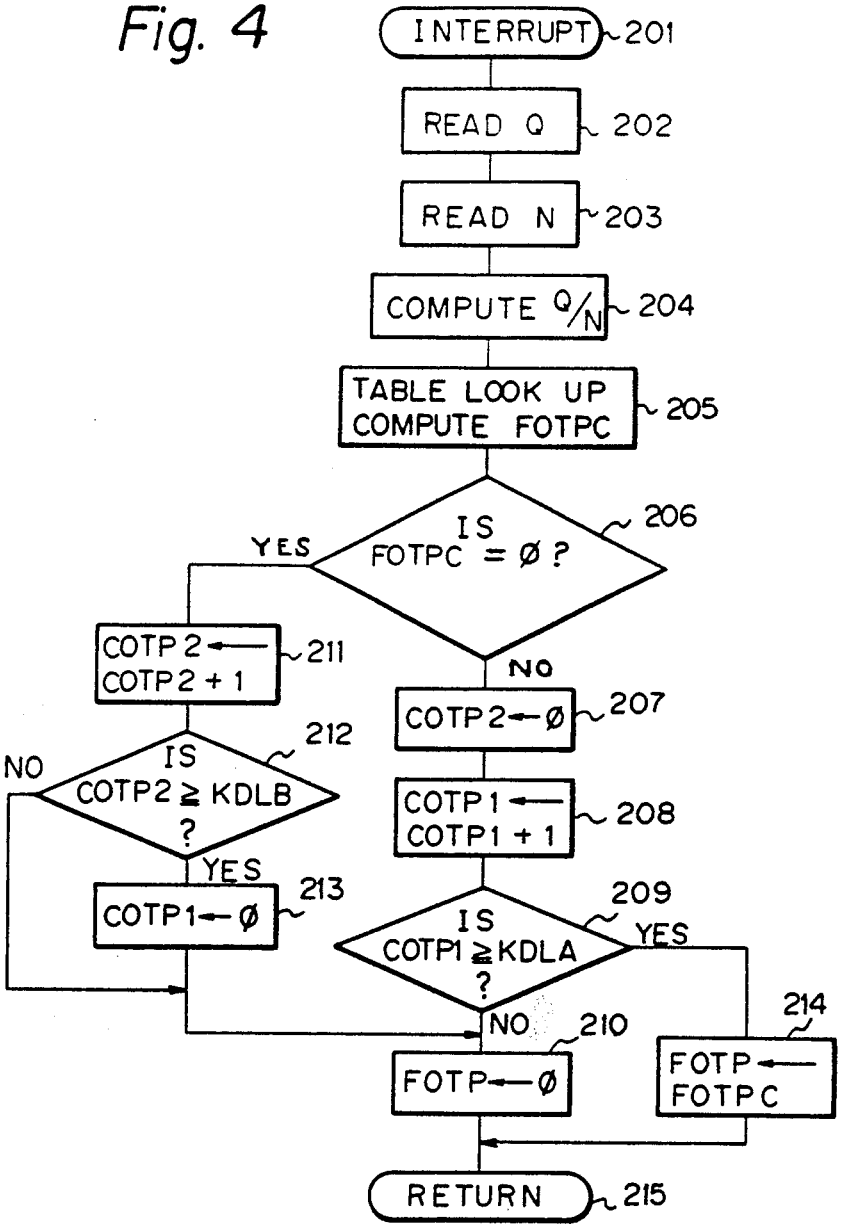
FIG. 4 is a flow diagram showing a routine for computing the additional fuel injection quantity.
Figure 5:
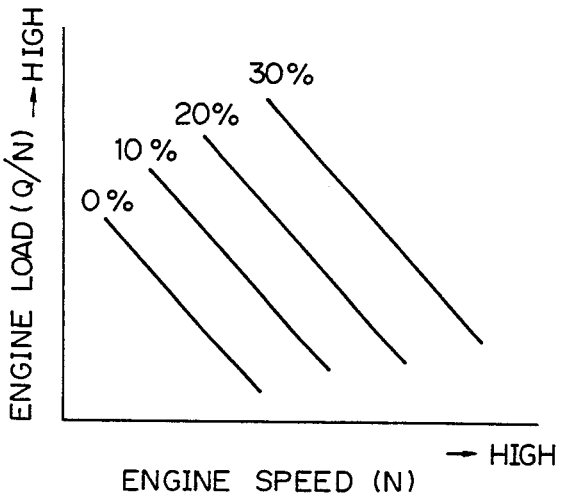
FIG. 5 is a graph showing an example of an additional fuel injection quantity.

FIG. 4 is a flow diagram of a routine implemented by the control unit 36 to compute the additional pulse width FOTP. This routine may be performed as an interrupt routine and initiated at every 4 milliseconds. After initiating the routine at 201, function 202 reads out the flow rate Q of intake air and function 203 reads out the rotational speed N of the engine. Function 204 calculates the intake air volume Q/N per one revolution. The Q/N value thus obtained is taken as representing the engine load. Then, according to the actual engine speed N and engine load Q/N, function 205 computes a theoretic additional pulse width FOTPC required to prevent overheating of the exhaust system. Function 205 is performed as a table look-up routine in which the CPU 60 looks-up a table reproduced in the graph of FIG. 5. The table specifies a different theoretic additional pulse width FOTPC for varying engine speed N and engine load Q/N and is preliminarily stored in the ROM 56. From the graph of FIG. 5, it will be noted that the theoretic additional pulse width FOTPC is zero for low-speed, light-load conditions of the engine, and increases in response to an increase in the engine speed, engine load, or a combination thereof. At function 205, the theoretic additional pulse width FOTPC may be obtained by table look-up and interpolation where necessary. Then, function 206 determines whether the theoretic additional pulse width FOTPC is zero. If FOTPC$\neq$0, meaning that the engine is operating under an accelerating condition, then function 207 resets a second delay counter COTP2 to zero and function 208 increments by one a first delay counter COTP1. Then, function 209 determines whether or not the count of the first counter COTP1 is greater than a first predetermined determination level KDLA. If it is not, meaning that the delay time counted by the first counter COTP1 does not exceed the preset time KDLA, then function 210 resets the additional pulse width FOTP to zero. If it is, meaning that the delay time counted by the first counter COTP1 has elapsed the preset time KDLA, then, function 214 substitutes the theoretic additional pulse width FOTPC for the additional pulse width FOTP and returns to the main routine at 215.

If in the determination at function 206, FOTPC=0, meaning that the engine is under a low speed, light-load condition, then function 211 increments by one the second delay counter COTP2 and function 212 determines whether the count of the second delay counter COTP2 is greater than a second predetermined determination level KDLB, which is set to be smaller than the first determination level KDLA. If COTP2≧KDLB, meaning that the time counted by the second counter COTP2 has passed the preset time KDLB, then function 213 is performed to reset the first delay counter COTP1 to zero. If COTP2<KDLB, meaning that the preset time KDLB has not elapsed, then function 210 is performed to reset the additional pulse width FOTP to zero.

From the foregoing, it will be understood that the first delay counter COTP1 functions as a counter for measuring the time interval in which the theoretic additional pulse width FOTPC is greater than zero. The first counter COTP1 functions to hold its present count even though the theoretic additional pulse width FOTPC is zero, the first counter COTP1 being reset to zero only when the second counter COTP2 counts over the preset value KDLB. On the other hand, the second delay counter COTP2 functions to measure the time interval in which the theoretic additional pulse width FOTPC is zero, the second counter being reset to zero when the FOTPC is not equal to zero. When the first delay counter COTP1 counts over the preset level KDLA, the theoretic additional pulse width FOTPC is used as the final additional pulse width FOTP (function 214) so that, at function 106 of the flow diagram of FIG. 3, the final executive pulse width $\tau$ is increased by the additional pulse width FOTP, to thereby enrich the combustible mixture over the stoichiometric air/fuel ratio. Conversely, if at function 210 the final additional pulse width FOTP is made zero, then at function 106, the executive pulse width $\tau$ is made equal to the basic pulse width $\tau_{BASE}$ so that additional fuel is not injected thereby providing a stoichiometric combustible mixture.

Figure 6:
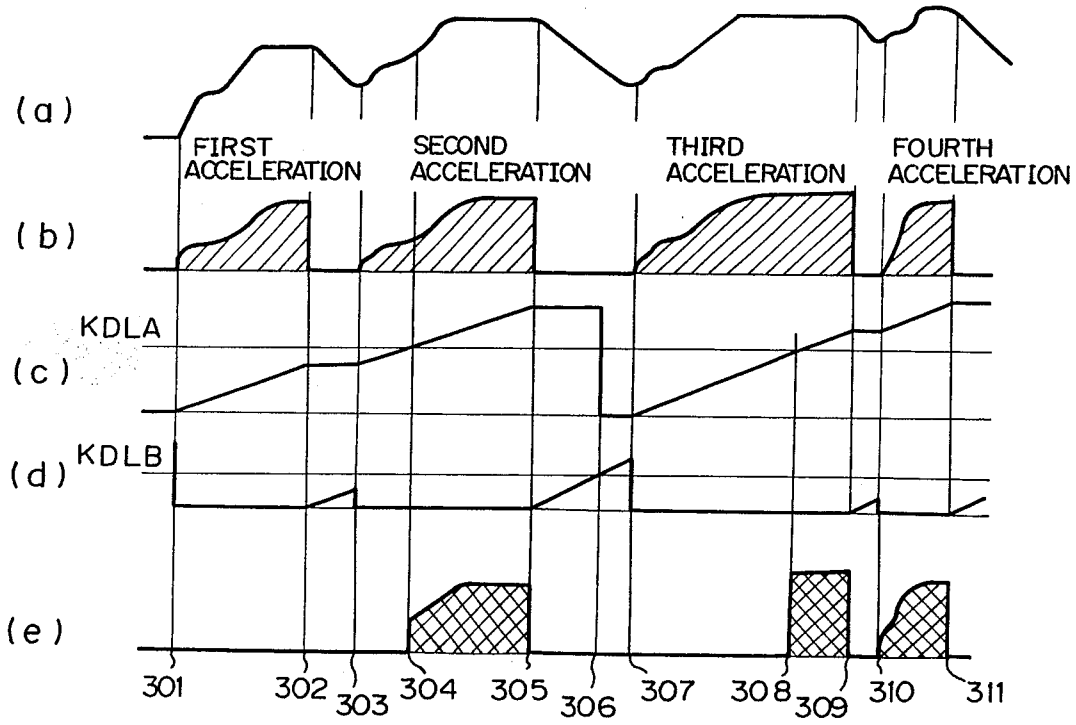
FIG. 6 is a composite time chart showing the function of the fuel supply system according to the invention.
Figure 7:
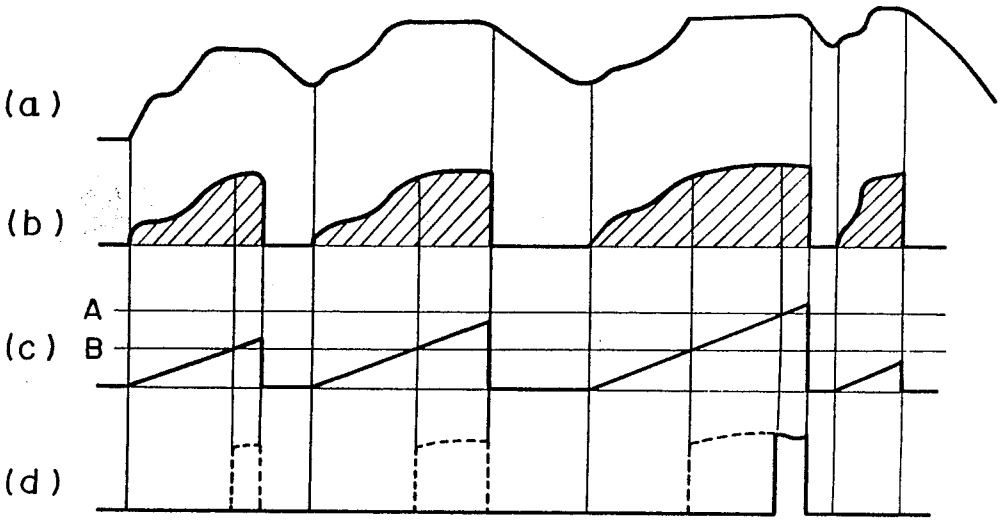
Fig. 7 (PRIOR ART)
FIG. 7 is a similar time chart illustrating the function of the previously proposed fuel supply system.

This will be understood more readily when referring to the composite time chart of FIG. 6, which is similar to the time chart of FIG. 7 and in which curve (a) represents the running mode of the vehicle indicated in terms of vehicle speed, curve (b) represents the variations in the theoretic additional pulse width FOTPC computed at function 205 of FIG. 4, curve (c) represents the count of the first delay counter COTP1, curve (d) indicates the count of the second delay counter COTP2, and curve (e) indicates the variations in the final additional pulse width FOTP. The abscissa represents an elapse of time. As shown by curve (a), in this running mode there are four cycles of acceleration, so that the theoretic additional pulse width FOTPC correspondingly depicts four cycles of increase as shown by curve (b).

When acceleration occurs at the time point 301, the theoretic additional pulse width FOTPC becomes larger than zero so that the second counter COTP2 is reset to zero and the first counter COTP1 starts counting. The first acceleration cycle terminates at the time point 302 at which the second counter COTP2 starts counting, but the first counter holds its present count. A second acceleration cycle takes place at the time point 303 and the FOTPC becomes greater than zero, so that the second counter COTP2 is reset to zero. Since at the time point 303 the count of the second counter COTP2 does not exceed the second preset level KDLB, the first counter COPT1 continues counting starting from the count at 302. At the time point 304, the count of the first counter COTP1 counts over the first preset level KDLA. This causes the theoretic additional pulse width FOTPC to be substituted for the additional pulse width FOTP (function 214 of FIG. 4) so that the engine is operated with an enriched mixture. The second acceleration cycle terminates at the time point 305 so that the FOTPC becomes zero. The first counter COTP1 stops counting but the second counter COTP2 starts counting. At the time point 306 between the second and third acceleration cycles, the count of the second counter COTP2 exceeds its preset level KDLB, whereby the first counter COTP1 is reset to zero at function 213 of FIG. 4. The third acceleration cycle begins at the time point 307, whereby the FOTPC becomes larger than zero so that the first counter restarts counting and the second counter is reset to zero. At the time point 308, the first counter counts over the preset level KDLA so that the FOTPC is substituted for the FOTP, thereby increasing the air/fuel ratio of the combustible mixture. The third acceleration cycle terminates at the time point 309 so that the FOTPC becomes zero, causing the first counter to stop counting and the second counter to start counting. At the time point 310, the fourth acceleration cycle takes place, resulting in FOTPC≠0. The first counter restarts counting from the count which is held from the time point 309. Since the count of the first counter at the time point 310 is, however, larger than the preset level KDLA, the FOTPC is substituted for the FOTP so that the combustible mixture is enriched immediately. The fourth acceleration cycle terminates at the time point 311, causing the FOTPC to become to zero, so that the first counter ceases counting and the second counter starts counting.

It will be apparent from the foregoing description that the first delay counter serves to set a delay time for delaying the supply of additional fuel, while the second counter serves to monitor the time interval between successive accelerations. The operation of the first counter is interrelated with the time interval between successive accelerations as measured by the second counter, so that the actual delay time is prolonged as the time interval between successive acceleration cycles increases and is shortened as the time interval is reduced. In contrast, in the previously proposed system discussed in the introductory part of this specification with reference to FIG. 7, the delay time has been set independently from the interval present between successive acceleration cycles. This resulted in a discrepancy in that the fuel consumption rate is increased if the delay time is set for a small value and the heat load on the exhaust system becomes excessive if the delay time is increased. In contrast, according to the present invention, the actual delay time as counted by the first delay counter is varied in relation to the time interval between successive acceleration cycles. This enables the first counter to have a larger preset level KDLA, as will be understood from the time chart of FIG. 6. In that case, fuel enrichment is not performed during the relatively short first acceleration period shown in FIG. 6, in which the acceleration cycle terminates before the temperature of the exhaust system is elevated above the tolerable level. Thus, according to the invention, the fuel consumption is minimized. When the second acceleration cycle takes place successively within a relatively short time period as shown in FIG. 6, then the actual delay time is shortened to promptly enrich the combustible mixture, thereby preventing overheating of the exhaust system. When a subsequent acceleration cycle takes place after a lapse of time sufficient to allow the exhaust system to be cooled, as in the case of the third acceleration cycle shown in FIG. 6, the first counter is reset to start counting from zero so that the delay time for the third acceleration cycle is set for the maximum value, thereby ensuring fuel economy.

Although the present invention has been described herein with reference to the specific embodiments thereof, various modifications and changes may be made without departing from the spirit of the invention. For example, the first and second counters have been described as having no upper limit. But, if there is a limit to the capacities of these counters, they may be reset to zero after their counts exceed the preset values KDLA and KDLB. Also, these values KDLA and KDLB may be varied depending on other engine parameters such as engine speed, intake pressure, flow rate of intake air, and coolant temperature.

I claim:

1. An electronically controlled fuel supply system for an internal combustion engine, which comprises:

(a) means responsive to a volume of intake air per revolution of the engine for computing a basic fuel supply amount per revolution;

(b) means responsive to engine speed and engine load for computing an additional fuel supply amount;

(c) means responsive to an accelerating condition of the engine for monitoring a time interval between successive acceleration cycles of the engine;

(d) means, responsive to said means for monitoring a time interval between successive acceleration cycles, for setting a variable delay time which increases in response to an increase in said time interval; and (e) electronically operated fuel supply means, responsive to said means for setting a variable delay time, for supplying the engine for each revolution thereof with fuel in an amount substantially equal to said basic fuel supply amount when an actual acceleration period counted from commencement of each acceleration cycle is less than said delay time and in an amount substantially equal to a sum of said basic and additional fuel supply amounts when the actual acceleration period from the commencement of an acceleration cycle exceeds said delay time.

2. A fuel supply system according to claim 1, wherein said means for setting a variable delay time comprises a first time counter which counts up in response to an accelerating condition of the engine and wherein said means for monitoring a time interval between successive acceleration cycles comprises a second time counter which counts up in response to a non-accelerating condition of the engine and is reset to zero in response to an accelerating condition, said first counter being reset to zero in response to the second counter counting over a predetermined count.

* * * * *